US007677478B2

(12) United States Patent
Maier et al.

(10) Patent No.: US 7,677,478 B2
(45) Date of Patent: Mar. 16, 2010

(54) FUEL INJECTION VALVE

(75) Inventors: Martin Maier, Moeglingen (DE); Joerg Heyse, Besigheim (DE)

(73) Assignee: Robert Bosch GmbH, Stuttgart (DE)

( * ) Notice: Subject to any disclaimer, the term of this patent is extended or adjusted under 35 U.S.C. 154(b) by 630 days.

(21) Appl. No.: 10/545,514

(22) PCT Filed: Nov. 19, 2003

(86) PCT No.: PCT/DE03/03841

§ 371 (c)(1),
(2), (4) Date: Aug. 25, 2006

(87) PCT Pub. No.: WO2004/076851

PCT Pub. Date: Sep. 10, 2004

(65) Prior Publication Data

US 2007/0012805 A1 Jan. 18, 2007

(30) Foreign Application Priority Data

Feb. 25, 2003 (DE) ..... 103 07 931

(51) Int. Cl.
*F02M 51/00* (2006.01)

(52) U.S. Cl. ..... 239/585.4; 239/533.2; 239/533.12; 239/585.1; 239/601

(58) Field of Classification Search ..... 239/584–585.2, 239/533.2, 533.9, 533.12, 5, 533.8, 533.14, 239/533.15, 601
See application file for complete search history.

(56) References Cited

U.S. PATENT DOCUMENTS 4,657,189 A 4/1987 Iwata et al.
5,163,621 A * 11/1992 Kato et al. ..... 239/533.12
5,878,713 A 3/1999 Kadota
7,306,173 B2 * 12/2007 Pilgram et al. ..... 239/585.5
2002/0144671 A1 10/2002 Shiraishi et al.

FOREIGN PATENT DOCUMENTS

| | | |
|---|---|---|
| DE | 196 25 059 | 1/1998 |
| DE | 198 15 918 | 10/1999 |
| DE | 198 38 771 | 3/2000 |
| DE | 198 54 828 | 5/2000 |
| DE | 199 54 102 | 5/2000 |
| DE | 199 58 126 | 6/2000 |
| DE | 101 18 163 | 10/2002 |
| DE | 101 22 350 | 11/2002 |
| JP | 11062787 | 3/1999 |
| JP | 11-117833 | 4/1999 |
| WO | WO 02/084104 | * 10/2002 |

* cited by examiner

*Primary Examiner*—Len Tran
*Assistant Examiner*—Jason J Boeckmann
(74) *Attorney, Agent, or Firm*—Kenyon & Kenyon LLP

(57) ABSTRACT

A fuel injector for the direct injection of fuel into a combustion chamber of an internal combustion engine includes an energizable actuator, a valve needle, which is in operative connection with the actuator and acted upon by a restoring spring in a closing direction to actuate a valve-closure member, which forms a sealing seat together with a valve-seat surface formed at a valve-seat body. The valve-seat body includes at least two spray-discharge orifices. The pressure of the fuel flowing through the fuel injector is greater than 10 bar.

10 Claims, 4 Drawing Sheets

FUEL INJECTION VALVE

FIELD OF THE INVENTION

The present invention is directed to a fuel injector for the direct injection of fuel into an internal combustion engine.

BACKGROUND INFORMATION

Published German patent document DE 196 25 059 discloses a fuel injector for the direct injection of fuel into a mixture-compressing internal combustion engine having external ignition, which injector provides a flow path for the fuel from a fuel intake to a spray-discharge orifice, in which flow path a plurality of fuel channels are arranged in front of the discharge orifice, the cross-section of the fuel channels determining the amount of fuel injected per time unit at the given fuel pressure. In order to influence the fuel distribution in an injected mixture cloud and to achieve selective skeining of the mixture cloud, at least a portion of the fuel channels is aligned such that in an open fuel injector the fuel jets exiting from the fuel channels are injected directly through the spray-discharge orifice.

Particularly disadvantageous in the fuel injector of the aforementioned are the limited opportunities for intervening in the formation of the mixture cloud. Apart from varying the jet broadening and the alignment of the center-of-gravity axis of the mixture cloud, there is barely any possibility of influencing deviations from the conical shape, e.g., irregular mixture clouds and heterogeneously distributed jet penetration. Accordingly, the possibilities for lowering the fuel consumption and exhaust emissions are limited.

SUMMARY

In the fuel injector according to the present invention, due to a high fuel pressure in the fuel-distributor line, it is possible to generate a mixture cloud that is of high atomization quality for a jet-directed combustion method without having to tolerate the disadvantages of fuel injectors with swirl inserts, e.g., high fuel consumption, coking of the valve tip, and increased emissions.

The spray-discharge orifices end in widened regions which advantageously provide effective coking protection in the discharge region of the spray-discharge orifices.

Due to a defined ratio l:d of overall length 1 or reduced length 1' on the intake side of the widened regions, and diameter d of spray-discharge orifices, it is possible to ensure that an optimal jet processing is able to be carried out.

The at least two spray-discharge orifices may advantageously be implemented in the valve-seat body as desired, for instance on concentric or eccentric hole disks or hole ellipses, or along straight or curved rows.

Furthermore, the center points of the spray-discharge orifices may be spaced apart from each other at uniform or different distances, just as the orientation of the axes of the spray-discharge orifices may be selected as desired.

It is advantageous that none of the spray-discharge orifices is directed toward the spark plug so that coking of the spark gap and a shortened service life are able to be avoided.

DETAILED DESCRIPTION

Figure 1:
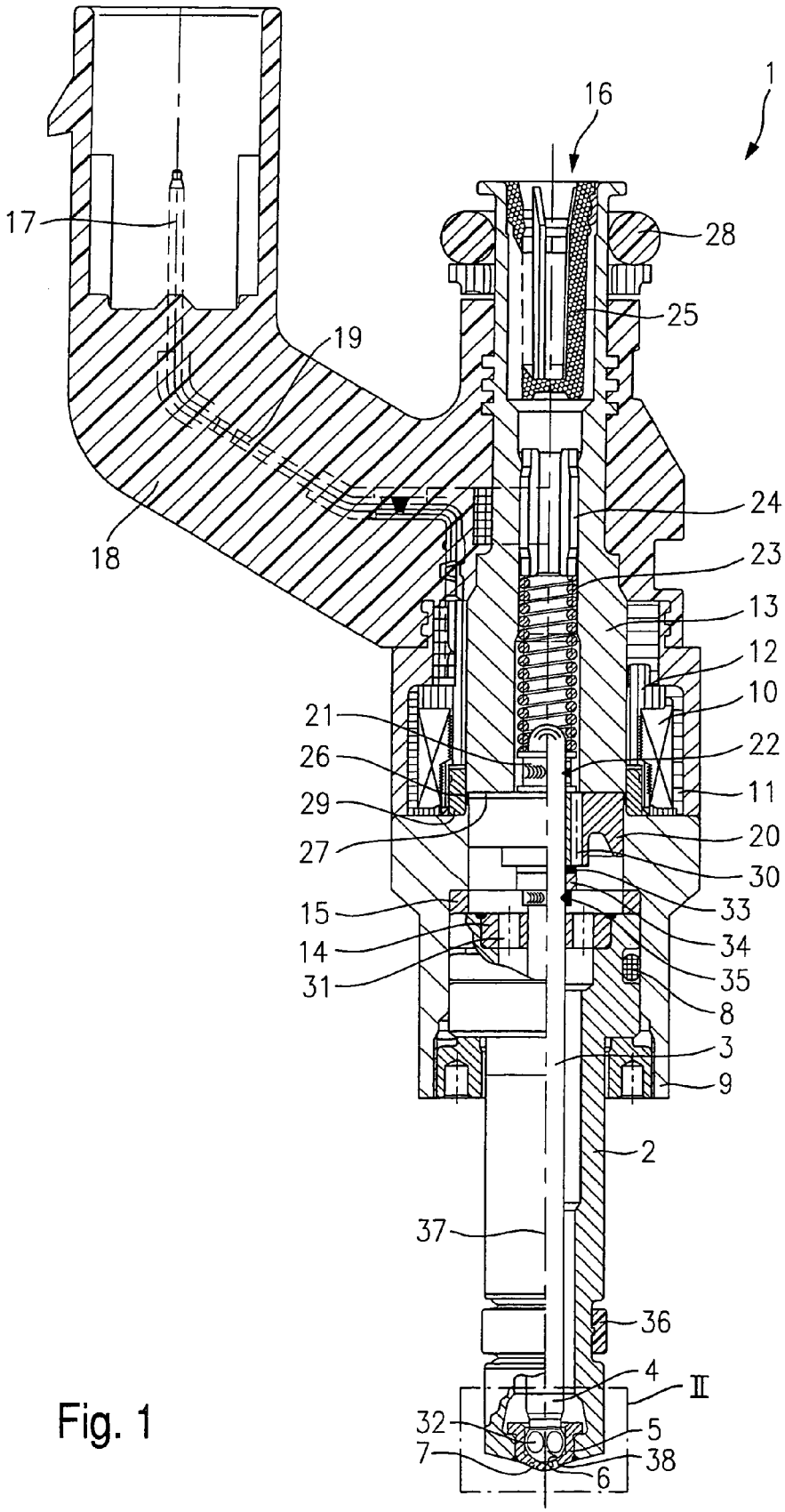
FIG. 1 shows a schematic cross-sectional view of an exemplary embodiment of a fuel injector configured according to the present invention.

FIG. 1 shows a sectional view of an exemplary embodiment of a fuel injector 1 according to the present invention. It is in the form of a fuel injector for fuel-injection systems of mixture-compressing internal combustion engines having external ignition. Fuel injector 1 is suited for the direct injection of fuel into a combustion chamber (not shown further) of an internal combustion engine.

Fuel injector 1 is composed of a nozzle body 2 in which a valve needle 3 is positioned. Valve needle 3 is in operative connection with a valve-closure member 4, which cooperates with a valve-seat surface 6 located on a valve-seat member 5 to form a sealing seat. The valve-closure body has a substantially spherical shape, and in this way contributes to an offset-free guidance in valve-seat body 5. In the exemplary embodiment, fuel injector 1 is an inwardly opening fuel injector, which has two spray-discharge orifices 7. According to the present invention, spray-discharge orifices 7 are provided in valve-seat body and include widened regions 38, which provide protection from coking. A detailed illustration of spray-discharge orifices 7 can be seen in FIG. 2, and further details are included in the following description.

A seal 8 seals nozzle body 2 against an outer pole 9 of a solenoid coil 10. Solenoid coil 10 is encapsulated in a coil housing 11 and wound on a coil brace 12 which rests against an inner pole 13 of solenoid coil 10. Inner pole 13 and outer pole 9 are separated from one another by a gap 26 and braced against a connecting member 29. Solenoid coil 10 is energized via a line 19 by an electric current, which may be supplied via an electrical plug contact 17. Plug contact 17 is enclosed by plastic coating 18, which is extrudable onto inner pole 13.

Valve needle 3 is guided in a valve-needle guide 14, which is disk-shaped. A paired adjustment disk 15 is used to adjust the (valve) lift. On the other side of adjustment disk 15 is an armature 20 which, via a first flange 21, is connected by force-locking to valve needle 3 joined to first flange 21 by a welding seam 22. Braced on first flange 21 is a restoring spring 23, which is prestressed by a sleeve 24 in the present example embodiment of fuel injector 1.

On the discharge-side of armature 20 is a second flange 34, which is used as lower armature stop. It is joined to valve needle 3 in force-locking manner by a welding seem 35. An elastic intermediate ring 33 is positioned between armature 20 and second flange 34 in order to damp armature bounce during closing of fuel injector 1.

Fuel channels 30 and 31 extend inside valve-needle guide 14 and armature 20. Beveled sections 32, which guide the fuel to the sealing seat, are formed at valve-closure member 4. The fuel is supplied via a central fuel feed 16 and filtered by a filter element 25. A seal 28 seals fuel injector 1 from a distributor line (not shown further). Another seal 36 provides sealing with respect to the cylinder head (not shown further) of the internal combustion engine.

In the rest state of fuel injector 1, restoring spring 23 acts upon first flange 21 at valve needle 3 against its lift direction, in such a way that valve-closure member 4 is retained in sealing contact against valve seat 6. Armature 20 rests on intermediate ring 33, which is supported on second flange 34. When solenoid coil 10 is energized, it builds up a magnetic field which moves armature 20 in the lift direction against the spring tension of restoring spring 23. Armature 20 carries along first flange 21, which is welded to valve needle 3, and thus carries valve needle 3 in the lift direction as well. Valve-closure member 4, being in operative connection with valve needle 3, lifts off from valve seat surface 6, thereby causing the fuel guided to spray-discharge orifice 7 to be spray-discharged.

In response to the coil current being turned off, once the magnetic field has sufficiently decayed, armature 20 falls away from inner pole 13 due to the pressure of restoring spring 23 on first flange 21, whereupon valve needle 3 moves in the direction counter to the lift. As a result, valve closure member 4 comes to rest on valve-seat surface 6 and fuel injector 1 is closed. Armature 20 sets down on the armature stop formed by second flange 34.

Figure 2:
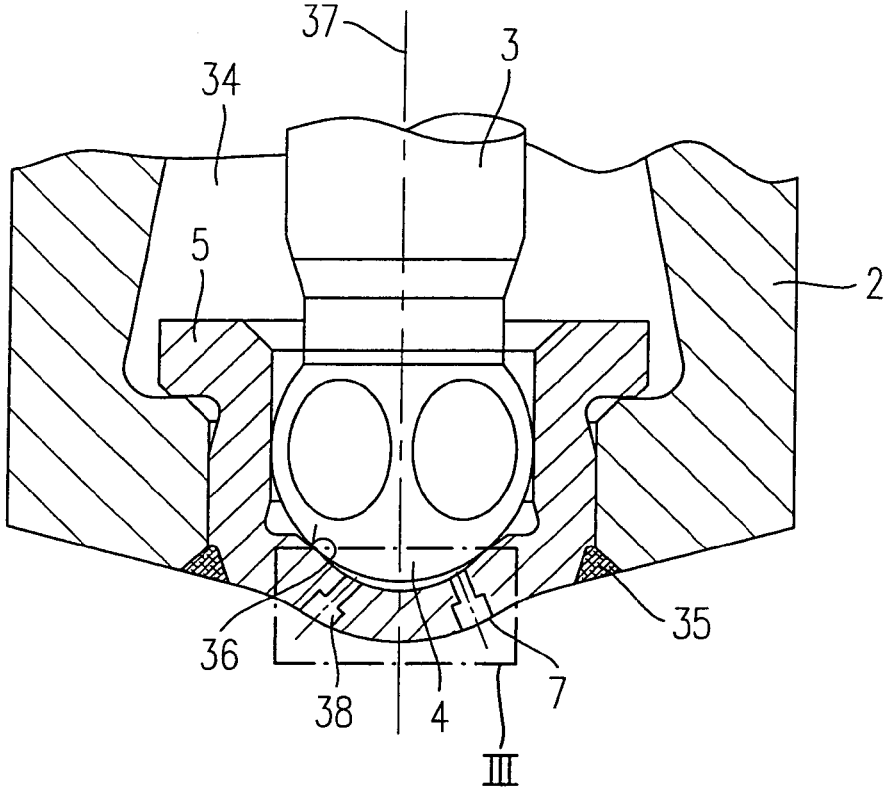
FIG. 2 shows a cross-sectional view of a portion of the exemplary embodiment of a fuel injector shown in area II in FIG. 1.

As can be gathered from FIG. 2, the present invention provides for stepped spray-discharge orifices 7 in valve-seat body 5. Spray-discharge orifices 7 widen into a widened region 38 along a discharge direction of the fuel. This measure provides protection from coking in the mouth regions of spray-discharge orifices 7. A deposit of fuel in the region of the spray-discharge orifices would otherwise cause a buildup of combustion residue, which increasingly reduces the diameter of spray-discharge orifices 7 and thus the quantity of spray-discharged fuel. As a consequence, fuel injector 1 is limited in its function and no longer provides sufficient fuel for combustion in the combustion chamber of the internal combustion engine. Increased fuel consumption and poorer emission values are the result.

In this undesirable scenario, an overall length 1 of spray-discharge orifices 7 may amount to $$1>3\cdot d.$$

given a predefined diameter d of spray-discharge orifices 7. For optimal jet processing, a fractional length 1' of spray-discharge orifices 7 on the inflow side (i.e., upstream) of widened region 38 must not exceed a specific value. The dimensions can be gathered from FIG. 3. The desired ratio of length 1' to diameter d (of narrow region of the orifice) thus is $$1>3\cdot d.$$

If no widened region 38 is provided, the following formula shall apply for overall length 1 of the spray-discharge orifice:

$$1>3\cdot d.$$

Figure 3:
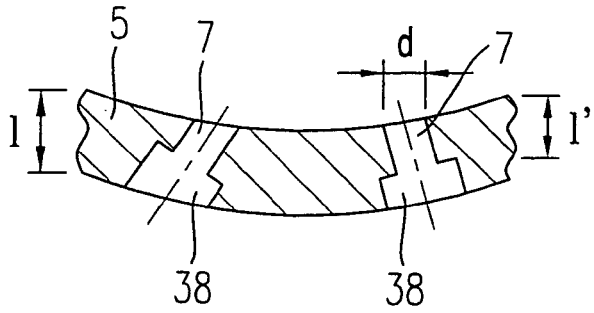
FIG. 3 shows an enlarged cross-sectional view of a portion of the exemplary embodiment in region III of FIG. 2.

The dimensions indicated above have been shown in FIG. 3.

Diameter d of spray-discharge orifices 7 amounts to $$d=\left(\frac{4\cdot c}{\pi\cdot n\cdot p^{0.5}}\right)^{0.5}$$

where $$0.3\leqq c\leqq 0.6\ [\mathrm{mm}^2\ \mathrm{Mpa}^{0.5}].$$

N denotes the number of spray-discharge orifices 7 and amounts to at least 2, p is the fuel pressure present in the fuel-distributor line, given in Mpa.

Spray-discharge orifices 7 in valve-seat member 5 may be implemented in any desired location. The configuration of spray-discharge orifices 7 may be made up of one or a plurality of round or elliptical hole circles arranged concentrically or eccentrically with respect to each other or to a center point of valve-seat body 5, or they may be made up of one or a plurality of straight or curved hole rows arranged in parallel, at an angle, an offset or without offset with respect to each other.

Figure 4:
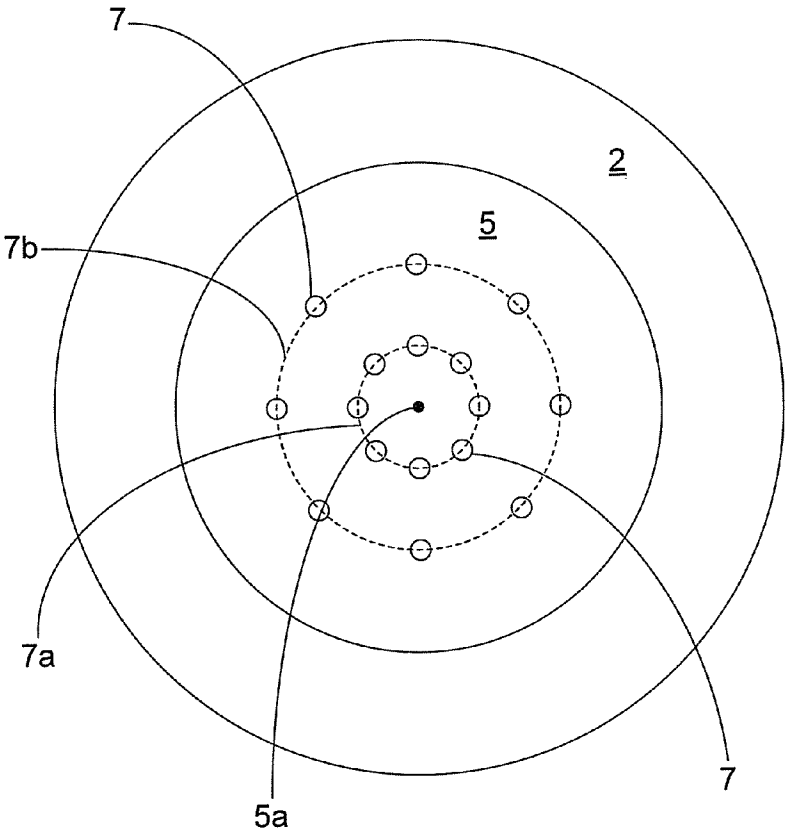
FIG. 4 shows a schematic bottom view of a further exemplary embodiment of a fuel injector according to the present invention.

FIG. 4 shows a schematic bottom view of a further exemplary embodiment of a fuel injector according to the present invention. Valve-seat body 5 includes a plurality of spray-discharge orifices 7 , whose centers are situated along two concentric circles 7*a*, 7*b*. Center points of circles 7*a*, 7*b* coincide with a center point 5*a* of valve-seat body 5.

Figure 5:
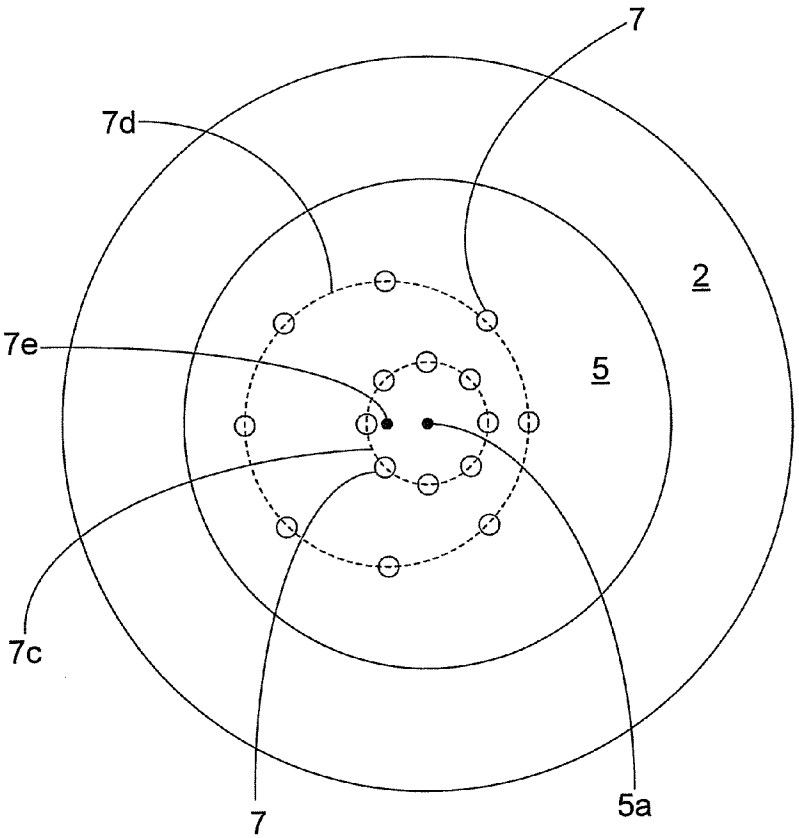
FIG. 5 shows a schematic bottom view of a further exemplary embodiment of a fuel injector according to the present invention.

FIG. 5 shows a schematic bottom view of a further exemplary embodiment of a fuel injector according to the present invention. In this embodiment, valve-seat body 5 includes a plurality of spray-discharge orifices 7, whose centers are situated along two eccentric circles 7*c*, 7*d*. Circle 7*c* has a center point that coincides with center point 5*a* of valve-seat body 5, while circle 7*d* has a center point 7*e*.

Figure 6:
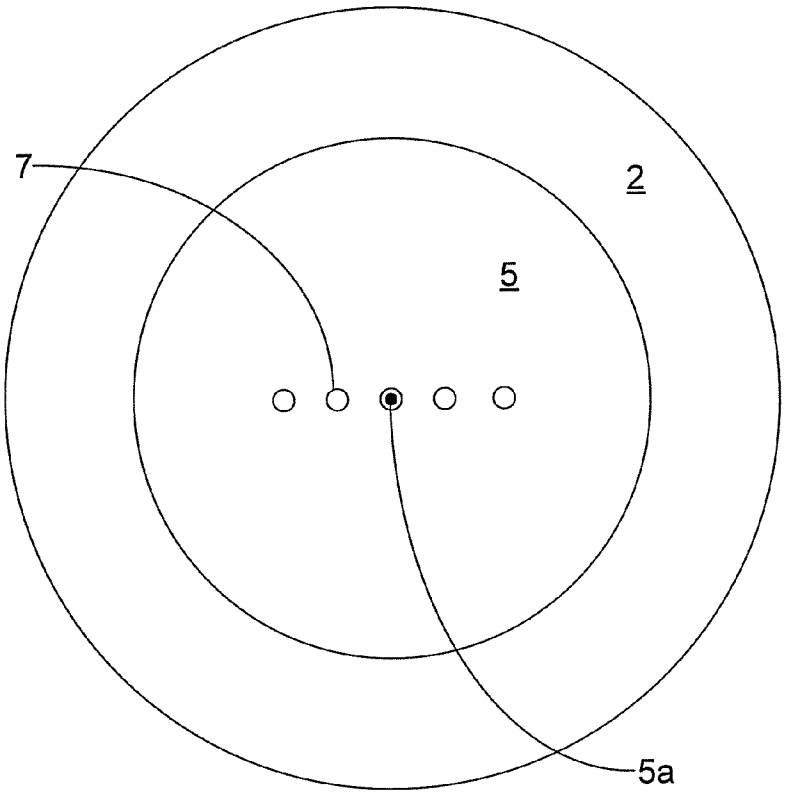
FIG. 6 shows a schematic bottom view of a further exemplary embodiment of a fuel injector according to the present invention.

FIG. 6 shows a schematic bottom view of a further exemplary embodiment of a fuel injector according to the present invention. In this embodiment, valve-seat body 5 includes a plurality of spray-discharge orifices 7 arranged in a row.

Figure 7:
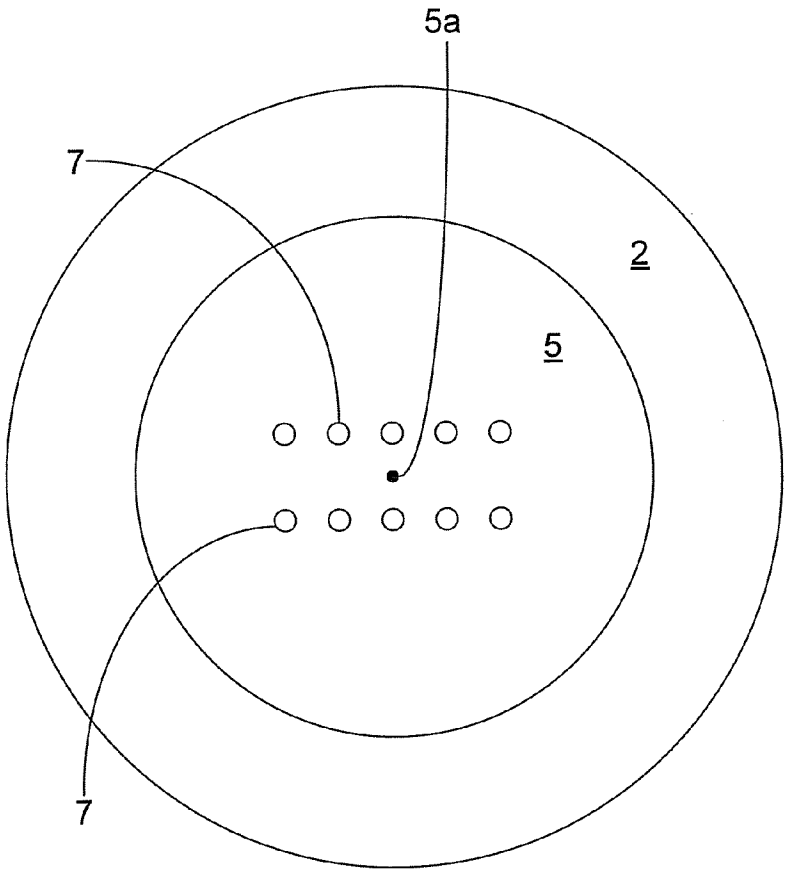
FIG. 7 shows a schematic bottom view of a further exemplary embodiment of a fuel injector according to the present invention.

FIG. 7 shows a schematic bottom view of a further exemplary embodiment of a fuel injector according to the present invention. In this embodiment, valve-seat body 5 includes a plurality of spray-discharge orifices 7 arranged in two rows.

The spacing between center points of spray-discharge orifices 7 may be of equal or different size, but should amount to at least 180% of diameter d of spray-discharge orifices 7 for reasons of production technology. The spatial orientation of a longitudinal axis of spray-discharge orifices 7 may differ for each spray-discharge orifice 7. However, none of the longitudinal axes is directed toward a spark plug (not shown further) also arranged in the combustion chamber of the internal combustion engine. This prevents a shortened service life of the spark plug.

The totality of all spray-discharge orifices 7 injects into the combustion chamber a mixture cloud whose center-of-gravity axis may be inclined between 0° and 70° in any spatial direction relative to a longitudinal axis 37 of fuel injector 1 and whose conical widening amounts to between 30° and 100°.

Wall thickness t of valve-seat body 5 is calculated as follows:

$$t\geqq k\cdot p^{0.5}\ [\mathrm{mm}],$$

where:

$$k=0.06\ \mathrm{mm/Mpa}^{0.5}$$

and fuel pressure p in the fuel-distributor line is indicated in Mpa.

In accordance with wall thickness t, overall length 1 and reduced length 1' of spray-discharge orifices 7 result at the respective tilt of spray-discharge orifices 7. Valve-seat body 5 is able to be processed in the corresponding regions in a simple manner.

The present invention is not limited to the exemplary embodiment shown and described, but is also applicable to other spray-discharge orifices 7, and also to any designs of inwardly opening, multi-hole fuel injectors 1.

What is claimed is:

1. A fuel injector for direct injection of fuel into a combustion chamber of an internal combustion engine, comprising:

an energizable actuator;

a valve needle in operative connection with the energizable actuator;

a sealing seat formed by a valve-closure member and a valve-seat surface of a valve-seat member, wherein the valve-seat member includes a plurality of spray-discharge orifices; and a restoring spring acting on the valve needle in a closing direction to actuate the valve-closure member;

wherein the pressure of fuel flowing through the fuel injector is greater than 10 bar;

wherein a diameter of the spray-discharge orifices increases along a discharge direction of the fuel to form a widened region;

wherein the diameter of the spray-discharge orifices increases in a stepwise manner;

wherein the ratio of an overall length l of the spray-discharge orifices to a smallest diameter d of the spray-discharge orifices is $l \leqq 3d$;

wherein a fractional length l' of the spray-discharge orifices extending from an inflow side to the widened region is such that the ratio of the fractional length l' to a smallest diameter d of the spray-discharge orifice is $l' \leqq 3d$;

wherein the smallest diameter d is defined by the equation $$d = \left(\frac{4 \cdot c}{\pi \cdot n \cdot p^{0.5}}\right)^{0.5}$$

wherein c is a constant, n is the number of the spray-discharge orifices, and p is the pressure of fuel;

and wherein $0.3 \leqq c \leqq 0.6$ [$mm^2$ $Mpa^{0.5}$].

2. The fuel injector as recited in claim 1, wherein a wall thickness t of the valve-seat body satisfies the relationship $t \leqq k - p^{0.5}$[mm], wherein k is a constant and p is the pressure of fuel; and wherein k is approximately 0.06 mm/$Mpa^{0.5}$.

3. The fuel injector as recited in claim 1, wherein the spray-discharge orifices are arranged such that center points of the spray-discharge orifices are situated along one of a single circle and a plurality of circles that are positioned one of concentrically and eccentrically with respect to one of each other and a center point of the valve-seat body.

4. The fuel injector as recited in claim 1, wherein the spray-discharge orifices are arranged in a pattern having one of a single row and a plurality of rows.

5. The fuel injector as recited in claim 1, wherein a distance between center points of any two adjacent spray-discharge orifices is substantially uniform.

6. The fuel injector as recited in claim 5, wherein the distance between center points of two adjacent spray-discharge orifices is at least 180% of the smallest diameter d of the spray-discharge orifices.

7. The fuel injector as recited in claim 6, wherein a spatial orientation of the longitudinal axis of each spray-discharge orifice is different from spatial orientations of the longitudinal axes of remainder of the spray-discharge orifices.

8. The fuel injector as recited in claim 1, wherein each spray-discharge orifice ends in a separate widened region.

9. The fuel injector as recited in claim 1, wherein the widened regions are arranged such that center points of the widened regions are situated along one of a single circle and a plurality of circles that are positioned one of concentrically and eccentrically with respect to one of each other and a center point of the valve-seat body.

10. The fuel injector as recited in claim 1, wherein the widened regions are arranged in a pattern having one of a single row and a plurality of rows.

* * * * *